United States Patent [19]

Camp

[11] 4,371,013

[45] Feb. 1, 1983

[54] METHODS OF STRAIGHTENING BACKPLANE-SUPPORTED PINS

[75] Inventor: Carey A. Camp, Richmond, Va.

[73] Assignee: Western Electric Company, Inc., New York, N.Y.

[21] Appl. No.: 182,731

[22] Filed: Aug. 29, 1980

[51] Int. Cl.[3] ..... B21F 1/02

[52] U.S. Cl. ..... 140/147

[58] Field of Search ..... 140/147

[56] References Cited

U.S. PATENT DOCUMENTS

| | | | |
|---|---|---|---|
| 3,542,087 | 11/1970 | Fegley | 140/147 |
| 3,603,357 | 9/1971 | Drummond | 140/147 |
| 3,664,016 | 5/1972 | Seve et al. | 140/147 X |
| 3,687,172 | 8/1972 | Suverkropp | 140/147 |
| 3,700,011 | 10/1972 | Walter | 140/147 |
| 3,730,234 | 5/1973 | Hasselmann | 140/147 |
| 3,742,987 | 7/1973 | Tarbox et al. | 140/147 |
| 3,779,291 | 12/1973 | Yeo | 140/147 |
| 3,903,937 | 9/1975 | Drummond | 140/147 |

*Primary Examiner*—Joseph H. McGlynn
*Assistant Examiner*—Fred A. Silverberg
*Attorney, Agent, or Firm*—J. B. Hoofnagle

[57] ABSTRACT

A backplane (22) supporting a plurality of pins (21) is supported in a fixture (84) which is mounted on a movable platform (51). A pair of straightening bars (82 and 83) are attached to a movable holding bar (76) above the backplane-supported pins (21) and are spaced at least a distance equal to the spacing between alternate rows of the pins. The straightening bars (82 and 83) are positioned to capture the tips of alternate rows of pins (21). The fixture (84) is then reciprocated in a first direction and then in a second direction to process the pins (21) through a single straightening cycle. Eventually, the straightening bars (82 and 83) and all of the rows of pins (21) are processed in a similar fashion whereby each of the pair of bars processes each row of pins through a single straightening cycle. In this manner, each pin (21) is processed ultimately through two straightening cycles.

7 Claims, 10 Drawing Figures

Fig. 1
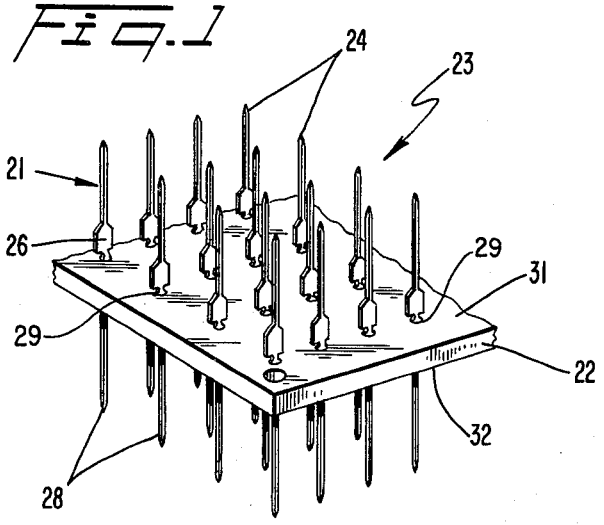
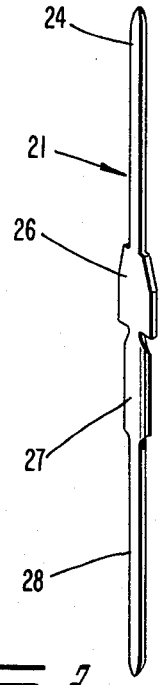
Fig. 2
Fig. 3
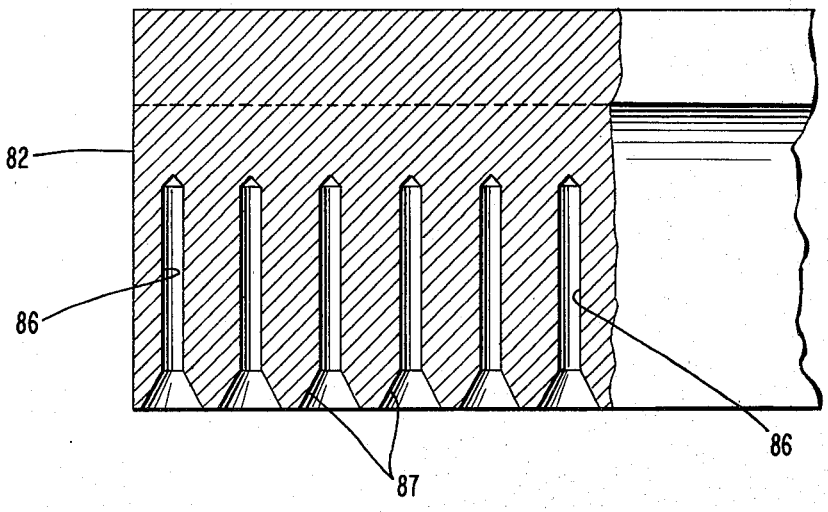

METHODS OF STRAIGHTENING BACKPLANE-SUPPORTED PINS

TECHNICAL FIELD

This invention relates to methods of straightening backplane-supported pins and particularly relates to methods of straightening backplane-supported pins utilizing a plurality of straightening bars.

BACKGROUND OF THE INVENTION

In the manufacture of some types of rigid pin-populated printed wiring boards, as many as 10,000 terminal pins are inserted into apertures of each of the boards. The boards are referred to as backplanes and typically measure eight inches by twenty-two inches on their sides. Typically, the spacing between adjacent apertures on each backplane is extremely small. For example, the spacing between apertures on one backplane is 0.125 inch. Moreover, each terminal pin typically has a square cross section of, for example 0.025 inch except in those areas where the pin is formed with (1) lateral ears having a push shoulder and (2) an aperture-engaging portion intermediate the ends thereof. The pin is relatively slender and typically measures one and one-half inches in length.

Each of the pins have slender shank portions which extend from opposite sides of the backplane. After the pins have been assembled with the backplane, the backplane is mounted in a frame where external wiring is wire wrapped to the pins on one side of the backplane commonly referred to as the wiring side. Other printed wiring boards, referred to as circuit packs, have electronic components electrically and mechanically secured thereto and have connectors secured to one end thereof. The connectors of these boards ultimately are inserted over selected ones of the pins extending from the other side of the backplane commonly referred to as the component side.

During the insertion of the pins into the apertures of the backplane and during subsequent handling of the pin-populated backplane, some of the pins may be bent undesirably. For example, the most severely bent pins may deviate from an axial centerline by 0.050 inch in any direction.

Since the component side of the pins are destined for insertion into a connector, and the pins on the wiring side may be wired by an automatic wiring facility, it is important that the pins be axially straight and perpendicular to the plane of the backplane within an acceptable tolerance. Otherwise, a slightly bent pin on the component side, for example, could be misaligned with its mating aperture in the connector. As the connector is moved into place, the bent pin would engage the face of the connector and would be bent further towards the surface of the backplane thereby failing to provide the required electrical connection. Such bent pins are very difficult to repair after they have been assembled and wired. More often, bent pins wear on mating connector surfaces, thus, degrading the electrical connection.

Since the pins are located on a grid spacing of 0.125 inch, and since the pins have a square cross section of 0.025 inch, the facing portions of adjacent pins are 0.100 inch apart. Consequently, it is most difficult to provide a facility for straightening pins which are so closely arranged. For example, a straightening facility typically is positionable over the tip of the pin to be straightened and is then moved in a selected motion whereby the walls of the opening engage and move the pin close to the centerline of the opening. To accomplish this straightening operation, a pin-receiving opening of the facility must be slightly larger in cross section than the cross section of the pin. Further, to insure that a bent pin will enter the pin-receiving opening, the mouth of the opening should be formed with a tapered or conical lead-in portion of sufficient dimension to receive any pin having a deviation as severe as 0.050 inch. Thus, the conical lead-in portion of the opening would require additional space in the cross section direction. In addition, the facility must have some bulk around the pin-receiving opening to provide for the opening and the conical lead-in portion. Thus, it is apparent that, with the close spacing between adjacent pins, it is most difficult to provide a sturdy facility which can accomplish the straightening of the pin.

Still another problem encountered in straightening the pins is due to warpage of the backplane after the pins have been inserted into the backplane. Such warpage is due to the pin density and the interfacial relationship between the apertures and the pins. Consequently, while any pin may be perpendicular with the backplane, if the backplane is warped, the tip of the pin would appear to be bent. This would provide an indication that the pin requires straightening even though the pin is perpendicular with the portion of the backplane surrounding the aperture into which the pin is mounted.

As noted above, as many as 10,000 pins are typically inserted into apertures of a single backplane. In a typical manufacturing operation, many pin-populated backplanes are assembled within relatively short periods of time. Since each pin must be straightened on both sides of the backplane, efficiency dictates that pluralities of pins be straightened simultaneously. However, when such mass pin straightening is considered, the above-mentioned problems resulting from the closeness of adjacent pins and warpage of the backplane pose serious difficulties.

Statistical studies have shown that processing each pin through two straightening wiggles provides tighter tolerance control of pin tip location. Such control will usually bring the pin tip within an acceptable tolerance of $\pm 0.009$ inch from true axial centerline.

In one prior system which provides facility for limited mass straightening of pins, a single bar has two rows of pin-receiving apertures formed in one surface thereof and is referred to herein after as the double-row bar. The pin-populated backplane is mounted on a table below the double-row bar. The double-row bar is lowered to position the tip ends of two adjacent rows of a plurality of rows of the pins into the pin-receiving apertures of the bar. Thereafter, the double-row bar is reciprocated, or wiggled, in the plane of the rows of pins which is referred to as the "X" direction. As the double-row bar is wiggled, the pins engage laterally spaced walls of the apertures whereby each of the pins is generally aligned in the "X" direction. The table is then reciprocated, or wiggled, in a plane referred to as the "Y" direction which is perpendicular to the plane of the "X" direction movement whereby the same pins are generally aligned in the "Y" direction. Thus, by this action, each of the pins in the two rows could be generally aligned with the centerline of the respective pin-receiving aperture. The double-row bar is then retracted and the table is indexed to locate the next two rows of pins directly beneath the two rows of apertures of the double-row bar. The double-row bar is then lowered and a straightening operation conducted as described above. This process continues until all pins are straightened. This type of system performs the straightening operation as described providing the grid spacing of the pins in the backplane is sufficiently spaced to avoid engagement by the double-row bar with previously straightened pins during the wiggle motion in the "Y" direction.

A prior system of this type is commercially available from Ambrit, Inc. of Wilmington, Massachusetts, as their Model No. 218.

In order to provide for the straightening of pins located on a grid spacing of 0.125 inch, a single bar having one row of apertures which is referred to hereinafter as the single-row bar, was utilized as described hereinabove. The width of the single-row bar measures about 0.125 inch. Thus, when the single-row bar is positioned over a single row of pins, the sides of the bar are located 0.050 inch from the pins of the immediately adjacent rows. A conical lead-in portion of each aperture of the single-row bar has a mouth diameter of 0.120 inch to insure that drastically bent pins are inserted into the pin-receiving aperture. The "X" and "Y" wiggle motion is the same as described above with respect to the double-row bar. In order to provide sufficient straightening effect in the "Y" direction, the table is wiggled to provide a 0.100 inch movement on each side of the centerline of the row of pins within the apertures of the single-row bar. Since the pins of the adjacent rows are only 0.050 inch from the side of the single-row bar, the adjacent pins are bent away from the pins located within the bar.

In order to compensate for this effect, a first row of pins located within the single-row bar are initially and properly straightened in the "X" direction. Thereafter, the table is wiggled, as noted above, in the "Y" direction. However, the pins of the first row are purposely not fully straightened in the "Y" direction but are leaning slightly in the "Y" direction toward the adjacent or second row of pins which is the next row of pins to be straightened. The single-row bar is then retracted and positioned over the second row of pins which are then straightened properly in the "X" direction. Thereafter, the bar is wiggled in the "Y" direction between the first and a third row of pins.

As noted above, the pins of the first row have been straightened in the "X" direction but are leaning slightly in the "Y" direction toward the second row of pins, the tip ends of which are now located within the apertures of the single-row bar. As the single-row bar is wiggled in the "Y" direction, one side of the bar engages the slightly bent pins of the first row and bends the pins in the "Y" direction so that the pins are now leaning away from the second row of pins. As the single-row bar moves in the wiggle motion toward the third row of pins and away from the first row of pins, the pins of the first row now tend to return to the initial position of leaning toward the second row of pins but only spring to a generally straightened position. After the bar has completed its wiggle motion in the "Y" direction, the pins of the second row are leaning slightly in the "Y" direction toward the third row of pins. In this way, the pins of the first row are generally straight but the pins of the second row are leaning in the "Y" direction toward the pins of the third row.

The single-row bar is then retracted and positioned over the tip ends of the pins of the third row and the pins are straightened in the "X" direction. The bar is wiggled in the "Y" direction whereby the pins of the second row are straightened in the "Y" direction in the same manner previously described with respect to the pins of the first row.

This pattern of operation is continued whereby the table is indexed in the "Y" direction to position successive rows of pins beneath the single-row bar. The single-row bar is then lowered over the tips of the pins and wiggled to straighten the pins in the "X" direction. The bar is then wiggled in the "Y" direction to effectively straighten the pins of the immediately trailing row in the "Y" direction while leaning the row of pins positioned within the bar toward the immediately forward row of pins. Ultimately, all pins of the backplane are thereby straightened in the "X" and "Y" directions.

The above-described single-row bar straightens one row of pins at a time. In addition, due to the closeness of the adjacent rows of pins, the single-row system must depend on the side of the bar for straightening the pins in the "Y" direction. Further, a limited number of pins is straightened using the single-row bar.

SUMMARY OF THE INVENTION

In a method of straightening pins supported in rows in a pin-populated backplane, in accordance with certain principles of the invention, two straightening bars are spacially mounted with a spacing at least equal to the distance between the spacing of alternate rows of pins. The straightening bars and alternate rows of pins are processed whereby a first of the two straightening bars provides a single cycle of straightening and a second of the two straightening bars provides a single cycle of straightening for each row of pins.

BRIEF DESCRIPTION OF THE DRAWINGS

FIG. 1 is a partial perspective view showing a backplane having a plurality of pins mounted therein;

FIG. 2 is a perspective view showing one of the pins of FIG. 1;

FIG. 5 is a partial sectional view showing a pin-straightening bar having a plurality of apertures each formed with a conically shaped mouth;

DETAILED DESCRIPTION

Figure 3:
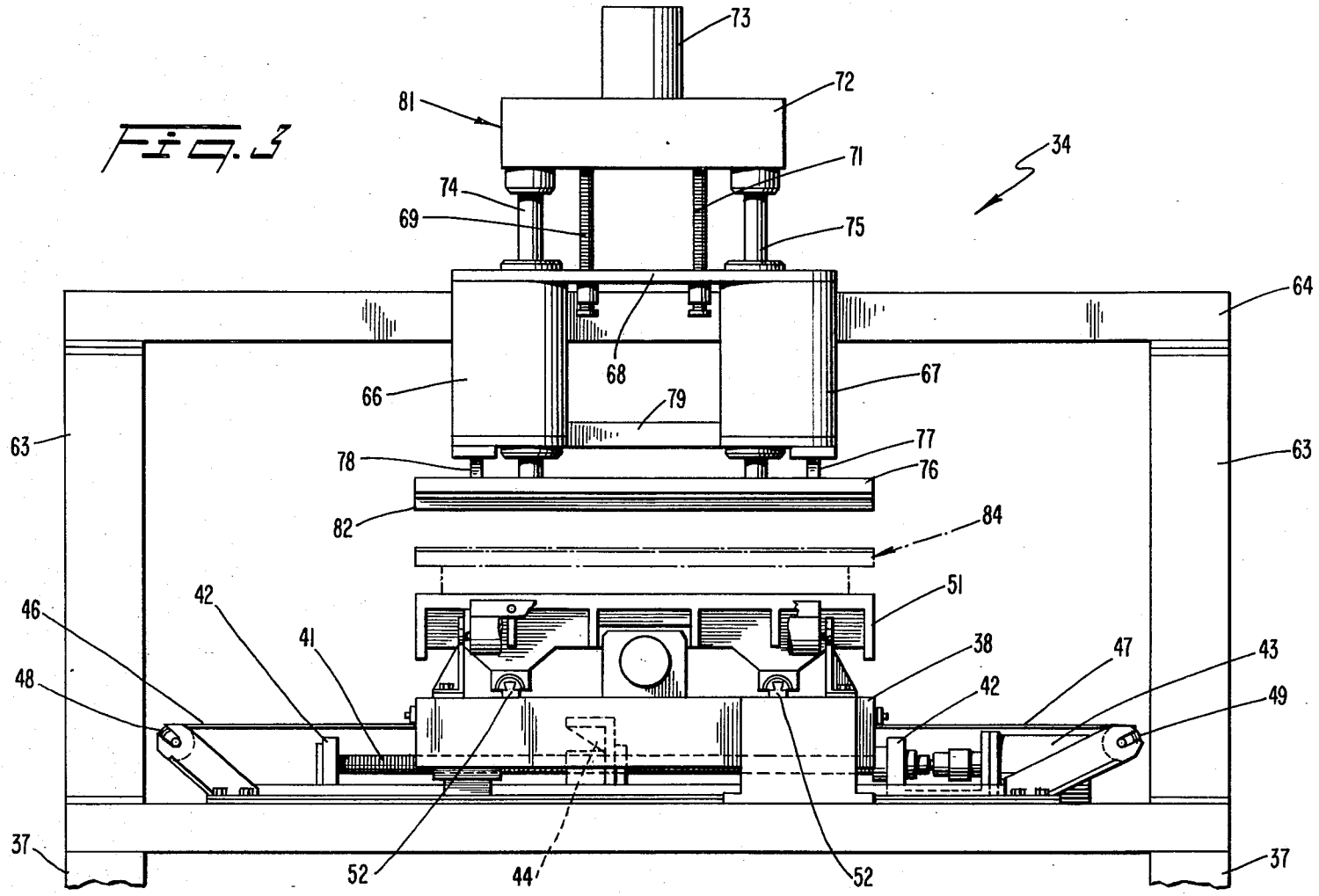
FIG. 3 is a front view of an apparatus for providing motion to straighten the pins of FIG. 1.

As illustrated in FIG. 1, a plurality of pins, designated generally by the numeral 21, are inserted into a printed wiring board or backplane 22 to form a pin-populated backplane assembly, designated generally by the numeral 23. Referring to FIG. 2, each pin 21 is formed with an upper shank 24, a shoulder section 26, an aperture-engaging section 27 and a lower shank 28. The shanks 24 and 28 generally have a square cross section measuring 0.025 inch on each side while the pin 21 measures one and one-half inches in length.

The backplane 22 (FIG. 1) typically has side dimensions of eight inches by twenty-two inches and may be formed with as many as 10,000 apertures 29 arranged in a grid of 0.125 inch spacing between centers of adjacent apertures. Thus, the facing sides of the shanks 24 and 28 of adjacent pins 21 in the backplane assembly 23 are spaced 0.100 inch apart.

The aperture-engaging sections 27 of the pins 21 are inserted into apertures 29 of the backplane 22 whereby the pins are supported with the backplane to form the assembly 23. The upper shanks 24 of the pins 21 are ultimately assembled at a high level of assembly with connectors of component-containing printed wiring boards (not shown). Therefore, the side of the backplane 22 adjacent to the upper shanks is referred to as the component side 31. The lower shanks 28 are ultimately connected to wiring of external circuits. Therefore, the side of the backplane 22 adjacent the lower shanks 38 is referred to as the wiring side 32.

As noted, the upper shanks 24 ultimately mate in a high level assembly operation with connectors of printed wiring boards. Therefore, it is important that the upper shanks 24 be axially straight and perpendicular to the component side 31 of the backplane 22 to facilitate the high level of assembly. In addition, the lower shanks 29 are frequently wired by the use of automatic wiring facilities (not shown). Therefore, it is important that the lower shanks 28 be axially straight and perpendicular to the wiring side of the backplane 22.

Figure 4:
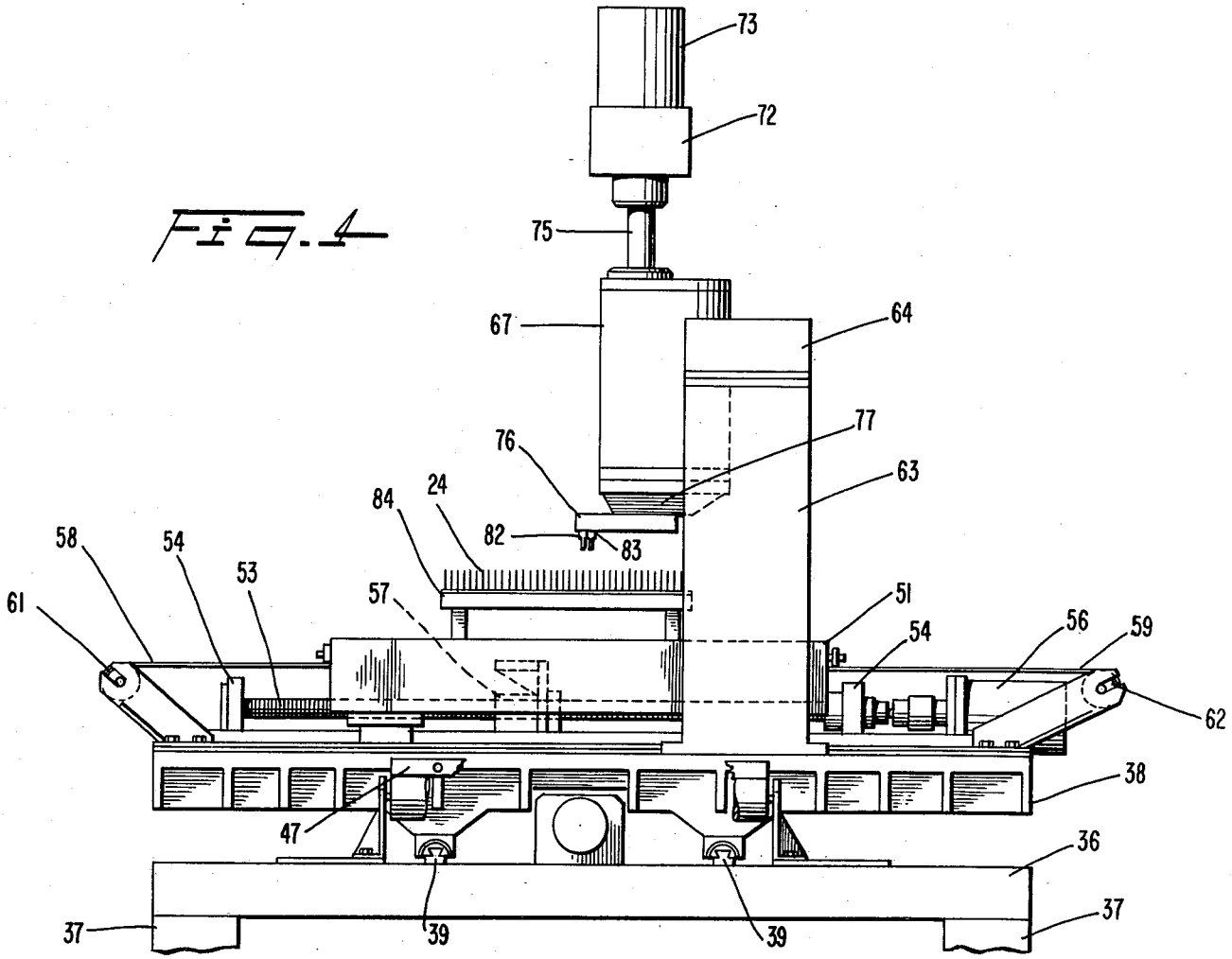
FIG. 4 is a side view of the apparatus of FIG. 3.

Referring to FIGS. 3 and 4, there is illustrated an apparatus, designated generally by the numeral 34, for facilitating the straightening of the backplane-supported pins 21. The apparatus 34 includes a horizontal table 36 supported by four vertical legs 37 which extend to the floor (not shown). A platform 38 is mounted for movement on a pair of spaced parallel dovetail rails 39 which are mounted to the top of the table 36. As illustrated in FIG. 3, a lead screw 41 is supported at opposite ends by bearings 42 which are mounted to the top of the table 36. A motor 43 is coupled to one end of the lead screw 41 and provides the drive to rotate the lead screw. A ball nut 44 is secured to the underside of the platform 38 and is threadedly positioned about the lead screw 41 for axial movement along the lead screw when the lead screw is rotated. Thus, rotation of the lead screw 41 provides motion for the platform 38 over the rails 39 in a plane of the platform which is referred to as the "X" direction.

A pair of rubber shades 46 and 47 are each connected at a free end thereof to opposite ends of the platform 38. The other ends of the shades 46 and 47 are attached to spring loaded reels 48 and 49, respectively, which are mounted to the top of the table 36. As the platform 38 is moved to the left or to the right, as viewed in FIG. 3, the shades 46 and 47 are maintained continuously and protectively over facilities located on the top of the table 36.

A second platform 51 is mounted on a pair of spaced dovetail rails 52 which are mounted to the top of platform 38. As illustrated in FIG. 4, a lead screw 53 is supported at opposite ends by bearings 54 which are mounted to the top of the platform 38. A motor 56 is coupled to one end of the lead screw 53 and provides the drive to rotate the lead screw 53 and provides the drive to rotate the lead screw. A ball nut 57 is secured to the underside of the platform 51 and is threadedly positioned about the lead screw 53 for axial movement along the lead screw when the lead screw is rotated. Thus, rotation of the lead screw 53 provides motion for the platform 51 over the rails 52 in a plane of the platform which is referred to as the "Y" direction.

As illustrated in FIG. 4, a pair of rubber shades 58 and 59 are each connected at a free end thereof to opposite ends of the platform 51. The other ends of the shades 58 and 59 are attached to spring loaded reels 61 and 62, respectively, which are mounted to the top of the platform 38. As the platform 51 is moved to the left or to the right, as viewed in FIG. 4, the shades 58 and 59 are maintained continuously and protectively over facilities located on the top of the platform 38.

Referring to FIG. 3, a pair of spaced vertical stands 63 are mounted on and extend upwardly from the top of the table 36. A horizontal support 64 extends between and is supported on the top of the vertical stands 63. A pair of bearing housings 66 and 67 are mounted on the horizontal support 64. A bearing plate 68 extends between and is secured to the bearing housings 66 and 67. A pair of lead screws 69 and 71 are mounted vertically near lower ends thereof in the bearing plate 68. The upper ends of the lead screws 69 and 71 are mounted within a housing 72 which supports a motor 73 on the top thereof. A timing belt (not shown) and pulleys (not shown) are contained within the housing 72 and facilitate the application of driving power from the motor 73 to the lead screws 69 and 71 when the motor is operated. Ball nuts (not shown), also contained within the housing 72, are threadedly positioned about the lead screws 69 and 71 and move axially along the lead screws when the lead screws are rotated.

The ball nuts are coupled to a pair of shafts 74 and 75 and provide for the vertical movement of the shafts when the lead screws 69 and 71 are rotated. The shafts 74 and 75 pass through the bearing housings 66 and 67, respectively, and support a holding bar 76 at the lower ends of the shafts. Thus, as the motor 73 rotates the lead screws 69 and 71, the shafts 74 and 75 are moved vertically to selectively move and position the holding bar 76 in the plane thereof. A pair of stops 77 and 78 extend downwardly from the bearing housing 66 and 67, respectively, to limit the upward travel of the holding bar 76.

A bottom plate 79 extends between and is secured to the bearing housings 66 and 67. The lead screws 69 and 71, the plates 68 and 79, the housing 72, the motor 73, the shafts 74 and 75, the holding bar 76 and the stops 77 and 78 form a slide assembly designated generally by the numeral 81. Vertical movement of the slide assembly 81, wherein the holding bar 76 moves vertically in the plane thereof, is referred to hereinafter as movement in the "Z" direction.

The portion of the apparatus 34, as illustrated in FIGS. 3 and 4 and which has been described hereinabove, and a system for controlling that portion of the apparatus, is a commercially available facility from Ambrit, Inc. of Wilmington, Mass., as their Model No. 202.

As illustrated in FIGS. 3 and 4, the apparatus 34 also includes two pin-straightening bars 82 and 83. The apparatus 34 further includes a backplane support fixture, designated generally by the numeral 84, which is illustrated in phantom in FIGS. 3 and 4. Referring to FIG. 5, pin-capturing undersurfaces of the bars 82 and 83 (not shown) are each formed with a single row of apertures 86 where the row extends generally from end to end of the bars. Each of the apertures 86 is formed with a conically shaped mouth 87. The bars 82 and 83 are attached to the holding bar 76 (FIGS. 3 and 4) for movement therewith and are positionable over the tips of the shanks 24 of the pins 21 extending upwardly from the pin-populated backplane assembly 23 which is mounted on the fixture 84.

Figure 6:
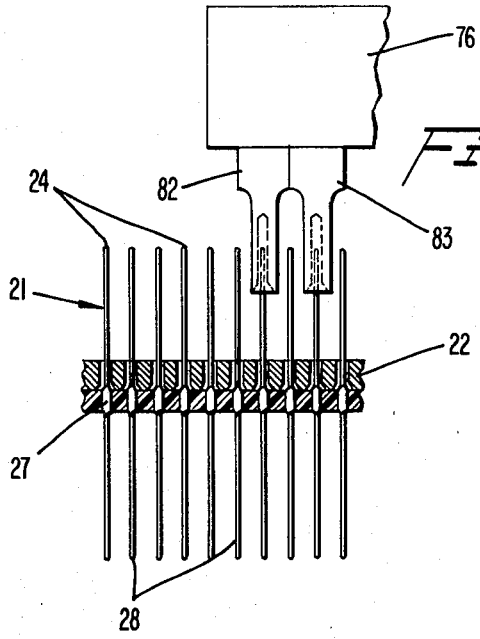
FIG. 6 is a side view showing the straightening bars of FIG. 5 in a pin straightening mode.

Referring to FIG. 6, the pins 21 are located on a grid spacing of 0.125 inch and since the pins have a square cross section of 0.025 inch, the facing sides of the shanks 24 and 28 of the adjacent pins are 0.100 inch apart. The straightening bars 82 and 83 moved in the "Z" direction and positioned over the tips of the pins 21 to be straightened. The platforms 38 and 51 (FIGS. 3 and 4) facilitate the movement of the fixture-supported pins 21 in the "X" and "Y" directions whereby the walls of the apertures 86 engage and move the pins close to the centerline of the opening. To insure that a bent pin 21 will enter apertures 84, the mouth 87 of the apertures is formed with a conically lead-in portion of sufficient dimension to receive any pin having a deviation as severe as 0.050. Consequently, the straightening bars 82 and 83 must have some bulk around the apertures 86 to provide for the apertures and the conically shaped mouth 87. Thus, as illustrated in FIG. 6, the close spacing between rows of pins 21 and the necessary size and shape of the straightening bars 82 and 83 prevent adjacent rows of pins 21 from being straightened simultaneously. As noted above, a single straightening bar having two rows of apertures will perform the straightening operation provided the grid spacing of the pins 21 in the backplane 22 is sufficiently spaced to avoid engagement by the double-row bar with previously straightened pins during the movement of the fixture supported pins in the "Y" direction. However, due to the small grid spacing of the pins 21, such a double row straightening bar can not perform the straightening operation without bending adjacent straightened pins.

Statistical studies have shown that processing each pin through two straightening cycles provides tighter tolerance control of pin tip location. Such control will usually bring the tip within an acceptable tolerance of ±0.009 inch from true axial centerline. The apparatus 34 is controlled to process each pin 21 through two straightening cycles as described hereinafter.

For the purpose of describing and illustrating the pin straightening operation of apparatus 34, reference will be made to FIGS. 7 through 10. The platforms 38 and 51 (FIGS. 3 and 4) are indexed by motors 43 and 56, respectively, to move the fixture 84 (FIGS. 3 and 4) and the backplane 22 supported thereon to position the first row of pins 21 directly beneath the straightening bar 82. The motor 73 is then operated to lower the holding bar 76 and the straightening bars 82 and 83 in the "Z" direction. As the straightening bars 81 and 82 are lowered the tips of all of the pins 21 of the first row are guided into and captured within the apertures 86 of the straightening bar 82 as illustrated in FIG. 7.

Thereafter, motor 43 (FIG. 3) is operated to rotate lead screw 41 (FIG. 3) in a first direction and then is operated to rotate the lead screw in the opposite direction. Operation of the motor 43 in the first and opposite directions, resulting in the reciprocation of fixture 84 in a wiggle movement and the backplane 22 supported thereon in a left-right pattern in the plane of the "X" direction as viewed in FIG. 3. In the preferred embodiment, the fixture 84 is reciprocated one time in the wiggle movement to move each straightening bar aperture 86 in the "X" direction by a distance of 0.110 inch in the positive "X" direction and 0.076 inch in the negative "X" direction with reference to the centerline of the aperture 86 which represents the centerline of an ideally straight pin 21.

Motor 56 (FIG. 4) is then operated to rotate lead screw 53 (FIG. 4) in a first direction and then is operated to rotate the lead screw in the opposite direction of rotation. Operation of the motor 56 in the first and opposite directions results in the reciprocation of fixture 84 in a wiggle movement and the backplane 22 supported thereon in a left-right pattern in the plane of the "Y" direction as viewed in FIG. 4. Motor 73 is then operated to raise the straightening bars 82 and 83 so that the undersurfaces of the bars are above the tips of the pins 21.

Figure 7:
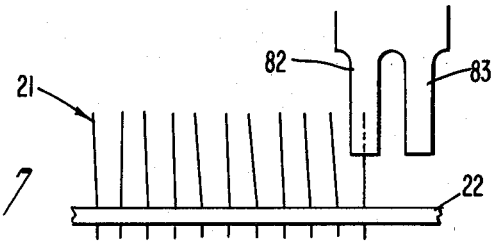
FIGS. 7, 8, 9 and 10 are side views showing the steps of processing through a pin straightening cycle.

Referring to FIGS. 7 through 10, one pin 21 of each of eleven rows of pins is illustrated with the first row appearing on the right and the eleventh row appearing on the left. As illustrated in FIG. 7, motor 73 is operated to lower straightening bars 82 and 83 until the tips of the pins 21 of the first row are captured within straightening bar 82. Motors 43 and 56 are then operated to wiggle the straightening bar 82 as described above. The pins 21 of the first row are purposely not fully straightened in the "Y" direction but are leaning slightly in the "Y" direction toward the adjacent or second row of pins which is the next row of pins to be straightened. The pins 21 are leaned in the "Y" direction toward the second row in preparation for a final straightening operation to be described hereinafter. Motor 68 is then operated to raise the straightening bars 82 and 83 so that undersurfaces of the bars are above the tips of the pins 21.

Figure 8:
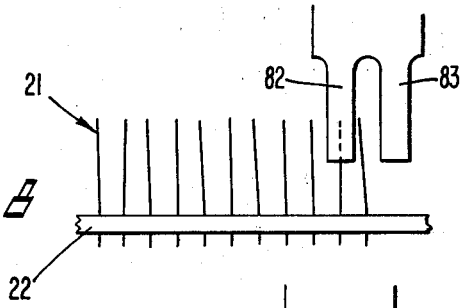

As illustrated in FIG. 8, motor 56 is operated to index the platforms 51 to locate the second row of pins 21 beneath the straightening bar 82. Thereafter, motor 73 is operated to lower the bars 82 and 83 to position the apertures 86 of straightening bar 82 to capture the tips of the second-row pins 21 as illustrated in FIG. 8. Motor 43 is operated to wiggle the straightening bar 82 as previously described to straighten the pins 21 of the second row in the "X" direction. Motor 56 is then operated to wiggle the straightening bar 82 as previously described to straighten the pins 21 of the second row in the "Y" direction.

As noted above, the pins 21 of the first row have been straightened in the "X" direction but are leaning slightly in the "Y" direction toward the second row of pins, the tip end of which are now located within the apertures 86 of the straightening bar 82. As the bar 82 is wiggled in the "Y" direction, one side of the bar engages the slightly bent pins 21 of the first row and bends the pins in the "Y" direction so that the pins are now leaning away from the second row of pins. As the bar 82 moves in the wiggle motion toward the third row of pins 21 and away from the first row of pins, the pins of the first row now tend to return to the initial position of leaning toward the second row of pins but only spring to a generally straightened position. Motor 73 is then operated to move the bar 82 upwardly until the underside of the bar is located above the plane of the tips of the pins 21. The pins 21 of the second row are slightly leaning in the "Y" direction toward the third row of pins.

Figure 9:
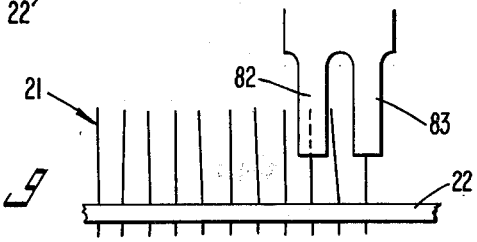

Motor 56 is operated to index the platform 51 to locate the third row of pins 21 beneath the straightening bar 82 and the first row of pins below the bar 83. Thereafter, motor 73 is operated to lower the bars 82 and 83 to position the apertures 86 to capture the tips of the first and third rows of pins 21 as illustrated in FIG. 9. Motor 43 is operated to wiggle the straightening bars 82 and 83 as previously described to straighten the pins 21 of the first and third rows in the "X" direction. Motor 56 is then operated to wiggle the straightening bars 82 and 83 are previously described to partially straighten the pins 21 of the first and third rows in the "Y" direction. The first-row pin 21 now have been processed through two straightening operations while the second-row pins and the third-row pins have been processed through one straightening operation.

This pattern of operation is continued whereby the platform 51 is indexed in the "Y" direction to position row of pins beneath the straightening bars 82 and 83. The bars 82 and 83 are then lowered over the tips of the pins 21 and the platform 38 is wiggled to straighten the pins in the "X" direction. The platform 51 is then wiggled in the "Y" direction to effectively straighten the pins of the immediately trailing row in the "Y" direction while leaning the rows of pins 21 positioned within the bars 82 and 83 toward the respective immediate forward row of pins. In order to straighten the last row of pins 21 on the backplane 22, one additional wiggle pattern in the "Y" direction must be performed in order to straighten the pins which are leaning due to the last straightening operation of the bar 83.

As an example, if the backplane 22 supports nine thousand pins 21 arranged in sixty rows of one hundred and fifty pins each in the "X" direction, and there are at least one hundred and fifty apertures 86 formed in the straightening bars 82 and 83, the bars will span the entire length of each row of pins during each "X" direction straightening operation. The platform 51 will have to be indexed sixty-two times in order to straighten each row of pins 21 once by each of the straightening bars 82 and 83. As noted above, there must be one additional straightening operation to straighten the pins 21 of the last row. Thus, the platform 51 must be indexed a total of sixty-three times. It takes approximately three seconds to complete one wiggle pattern in the "X" and "Y" directions combined. Thus, to straighten nine thousand pins as assembled above, takes one hundred and eighty-nine seconds. If this process was completed using a single-row bar, as noted above, the platform will have to be indexed a total of sixty times but the bar must perform two cycles of straightening for each row which gives a total of one hundred and twenty straightening operations. As noted above, there must be one additional straightening operation to facilitate the straightening of the last row. Thus, for the single row bar, there are one hundred and twenty-one straightening operations which takes three hundred and sixty-three seconds. By using the second straightening bar, there is a time savings of 47.93%. This time savings increases with the number of pins straightened and the number of bars used. Thus, by the use of the two straightening bars 82 and 83, the time required to straighten a plurality of pins 21 supported in rows in the pin-populated backplane 22 is nearly 50% less than the time required by a single straightening bar.

Figure 10:
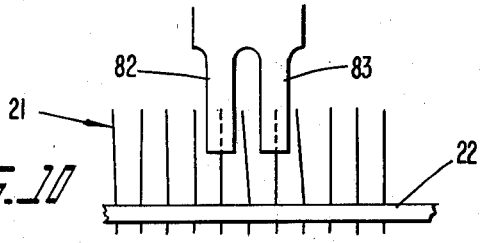

As illustrated in FIG. 10, the first three rows of pins have been processed through two complete cycles of straightening. The fourth row also have been processed through two cycles of straightening and will be fully straightened by the edge of straightening bar 83 during the second straightening cycle of the fifth row.

While the above-described number of straightening bars 82 and 83 is illustrative of the preferred embodiment, other combinations of the number of straightening bars, and the number of apertures in each row of all of the bars can be selected without departing from the spirit and scope of the invention.

What is claimed is:

1. A method of straightening pins supported in equally spaced rows in a pin-populated backplane, which comprises the steps of:

mounting spatially at least two straightening bars in a parallel relationship with a spacing at least equal to the distance between the spacing of alternate rows of pins;

capturing simultaneously tips of the pins of alternate rows within respective ones of the straightening bars during a straightening cycle;

processing the straightening bars and the captured rows of pins whereby a first of the two straightening bars provides a single straightening cycle for each of the rows of pins and a second of the two straightening bars provides a single straightening cycle for each of the rows of pins;

wherein after the straightening of each of the rows of pins by each of the bars and while the pins remain captured by each of the bars, the method further comprises the step of bending each of the captured rows of pins slightly toward the next adjacent row of pins to be straightened; and wherein during the straightening of the next adjacent row of pins by each of the bars, the method further comprises the step of moving the exterior side wall of each of the bars which is adjacent to the bent pins into engagement with the bent pins to facilitate the straightening thereof.

2. The method of straightening pins as set forth in claim 1, wherein the processing step comprises the steps of:

processing the first straightening bar successively with a first row and a second row of pins through pin-straightening cycles;

processing simultaneously the first and the second straightening bars and a third row and the first row of pins, respectively, through a pin-straightening cycle; and processing the second straightening bar successively with the second row and the third row of pins through a pin-straightening cycle.

3. The method of straightening pins as set forth in claim 1, which further comprises the steps of:

mounting the backplane in a support fixture; and indexing the fixture to position the rows of pins beneath the straightening bars.

4. The method of straightening pins as set forth in claim 1, wherein the step of processing comprises the step of moving relatively the straightening bars and the backplane to straighten the pins.

5. The method of straightening pins as set forth in claim 4, wherein the step of processing includes the steps of:

maintaining the straightening bars in a fixed position while the tips of the pins are positioned within the bars; and moving the support fixture in a predetermined pattern to straighten the pins.

6. The method of straightening pins as set forth in claim 5, wherein the step of processing comprises the step of processing simultaneously the first and second straightening bars through a single straightening cycle to straighten two rows of pins.

7. A method of straightening pins arranged at least in a first row, a second row and a third row of pins, which comprises the steps of:

processing the first row of pins through a pin-straightening cycle;

bending the first row of pins toward the second row of pins;

processing the second row of pins through a pin-straightening cycle and simultaneously straightening the first row of pins;

bending the second row of pins toward the third row of pins;

processing the first and third rows of pins through a pin-straightening cycle and simultaneously straightening the second row of pins;

bending the first row of pins toward the second row of pins and the third row of pins in a direction away from the second row of pins;

processing the second row of pins through a pin-straightening cycle and simultaneously straightening the first and third rows of pins;

bending the second row of pins toward the third row of pins;

processing the third row of pins through a pin-straightening cycle and simultaneously straightening the second row of pins;

bending the third row of pins in a direction away from the second row of pins; and straightening the third row of pins.

* * * * *